US006609547B1

(12) United States Patent
Machkovech

(10) Patent No.: US 6,609,547 B1
(45) Date of Patent: Aug. 26, 2003

(54) LOG SPLITTER ATTACHMENT FOR A SKID LOADER

(76) Inventor: Ron P. Machkovech, W6416 Prospect Rd., Juneau, WI (US) 54935

( * ) Notice: Subject to any disclaimer, the term of this patent is extended or adjusted under 35 U.S.C. 154(b) by 0 days.

(21) Appl. No.: 10/278,186

(22) Filed: Oct. 24, 2002

(51) Int. Cl.[7] ..... B27L 7/00

(52) U.S. Cl. ..... 144/366; 144/195.1; 180/53.1; 280/727

(58) Field of Search ..... 144/193.1, 195.1, 144/366; 180/53.1, 53.3, 53.7; 280/727

(56) References Cited

U.S. PATENT DOCUMENTS 4,258,765 A * 3/1981 Suomi ..... 180/53.3 X
4,285,374 A * 8/1981 Klingel ..... 144/195.1
4,446,898 A 5/1984 Manteufel
4,503,894 A 3/1985 Gratkowski
4,506,712 A 3/1985 Johnson
4,869,002 A * 9/1989 Glenn ..... 414/912
5,346,018 A * 9/1994 Koster ..... 180/53.1 X
5,803,141 A 9/1998 Patterson
6,408,907 B1 * 6/2002 Lantz ..... 144/195.1
6,520,226 B1 * 2/2003 Smith ..... 144/366

FOREIGN PATENT DOCUMENTS

WO PCT/AU92/00268 12/1992

* cited by examiner

*Primary Examiner*—W. Donald Bray
(74) *Attorney, Agent, or Firm*—Donald Cayen; Nicholas A. Brannen

(57) ABSTRACT

The log splitter of the present invention is interchangeably mounted to a skid loader in the same manner as conventional attachments, wherein the skid loader longitudinal axis and log splitter longitudinal axis are perpendicular. The log splitter has a mounting frame, a H-beam connected to the mounting frame, and a piston assembly and blade connected to the H-beam. The mounting frame has a top lip and a bottom flange. The skid loader has an attacher that engages the top lip and bottom flange of the mounting frame. The skid loader may supply power to the log splitter, so that the piston assembly pushes the head towards the blade. A user controls the orientation of the attacher, and hence the log splitter. The log splitter can pick a log off the ground, the skid loader can move while holding a log, and the log splitter can split a log over a receptacle.

21 Claims, 9 Drawing Sheets

LOG SPLITTER ATTACHMENT FOR A SKID LOADER

FIELD OF THE INVENTION

The present invention relates to a log splitter for removably attaching to a skid loader in the same manner as conventional skid loader attachments.

BACKGROUND OF THE INVENTION

People move and/or split logs for several reasons. Some people split logs to create smaller, more manageable pieces of wood. That is, splitting logs into pieces makes it easier to lift, transport, stack, and/or discard the logs. One way to split logs is by using a hand tool, such as an axe. There are obvious drawbacks and limitations to using a hand tool. For example, it takes a great deal of time and energy to split a sizable load of logs using a hand tool. Further, use of hand tools can be hazardous to the user's health. Repetitive strenuous motions can cause muscle strains or more serious injuries. Such problems are especially troublesome for the weak and elderly.

In recognition of the drawbacks and limitations of using hand tools, mechanical log splitters have been developed. Some presently available log splitters are designed to utilize a host vehicle's hydraulic power as the driving force for the splitter. Such designs are disclosed in U.S. Pat. No. 3,780,779 to Guy and U.S. Pat. No. 4,374,532 to Region. These designs only can accommodate logs having a length shorter than the host vehicle's piston stroke length. These designs therefore have limited practicality.

Further, U.S. Pat. No. 4,341,246 to Salladay and European Patent Number 0038375 A1 to Berr require special parts to be added to the host vehicle in order to utilize the host vehicle's piston. Such requirements further limit the practicality and desirability of the respective designs.

Some log splitters can be difficult to install to the host vehicle. It may be necessary for a person to manually lift a log splitter into place during installation. Weaker individuals or the handicapped may not be able to lift the log splitter. For them, it may be impossible to install the log splitter. Even if one can manage to lift the log splitter, it still can be difficult to simultaneously lift the log splitter while maintaining the requisite coordination for proper installation.

A further problem with many conventional log splitters is that a person must manually lift and position logs on the splitter. Such designs are disclosed in U.S. Pat. No. 4,506,712 to Johnson, U.S. Pat. No. 4,503,894 to Gratkowski, U.S. Pat. No. 4,446,898 to Manteufel, U.S. Pat. No. 4,340,098 to Scott, U.S. Pat. No. 4,262,714 to Pratt el al., U.S. Pat. No. 4,019,549 to Williams, and PCT International Publication Number WO 92/21491 to Sieling. The weak, elderly, or disabled may not even be able to lift the logs off the ground. If they can manage to lift the logs, they take the unnecessary risk of injuring their back. Additionally, logs can be slippery when wet. This can further compromise a person's ability to safely lift and position the logs.

A still further problem with some log splitters is that they are incapable of moving the logs over a receptacle before splitting them. It is time consuming to pick up and move individual pieces of the split log.

The design disclosed in U.S. Pat. No. 5,803,141 to Patterson is capable of working with logs resting on the ground and moving the logs over a receptacle before splitting the logs. The Patterson wood splitter is pivotally connected in hanging fashion to a boom of a host vehicle. The Patterson patent also has two rotatably connected components. Pivotally and rotatably connected components are weaker, more complex, and more expensive than rigid connections.

Hence, a need exists for improvements in log splitters.

SUMMARY OF THE INVENTION

The present invention relates to a log splitter that is interchangeably mounted to a host vehicle in the same manner as conventional attachments. One preferred host vehicle is a skid loader having a skid loader longitudinal axis. A hydraulic pump provides power to lift cylinders, which drive lift arms. The lift arms are attached to an attacher, having an attacher longitudinal axis and wedges. The skid loader longitudinal axis is perpendicular to the attacher longitudinal axis. Levers are provided on the attacher for actuating the wedges for locking an attachment to the attacher. The hydraulic pump also provides power to a tilt cylinder. The tilt cylinder is attached to and can change the orientation of the attacher, but the attacher longitudinal axis remains perpendicular to the skid loader longitudinal axis. Therefore, it is understood that references to spatial orientation are relative.

In accordance with the present log splitter invention, a mounting frame is provided. The mounting frame has beams oriented vertically and that generally lie in a common plane. A top rail is at the top of the beams and a bottom rail is at the bottom of the beams. A top lip is connected to the top rail. A bottom flange is connected to the bottom rail of the mounting frame. The bottom flange has holes formed therethrough.

A H-beam with a H-beam longitudinal axis is connected to the mounting frame. The H-beam has opposed first and second ends. The H-beam further has a front flange and a rear flange with a web therebetween. The front flange has outer and inner surfaces.

A piston assembly support plate is connected to the first end of the H-beam. The piston assembly support plate has a hole formed through it.

A blade is connected to the front flange of the H-beam at the second end of the H-beam. The blade has two opposed sides that converge at a cutting edge. The cutting edge is perpendicular to the longitudinal axis of the H-beam, and is oriented towards the first end of the H-beam.

A piston assembly has a cylindrical casing with two opposed ends. The piston assembly has a longitudinal axis, which is parallel to the H-beam longitudinal axis. The piston assembly support plate supports the first end of the cylindrical casing. One or more U-shaped bolts secure the piston assembly to the front flange of the H-beam. A piston rod extends from the cylindrical casing. Two hoses supply hydraulic power from the host vehicle to the piston assembly.

A head is attached to the piston rod. The head has a pusher plate and a track plate. The head has channels that allow the head to slideably engage the front flange of the H-beam. The piston rod forces the head along its path in directions parallel to the piston assembly's longitudinal axis.

The log splitter is quickly, easily, and interchangeably mounted to a skid loader the same way as conventional attachments are mounted to the skid loader. The log splitter attachment is installed while it rests on the ground. The weight of the log splitter is inconsequential, as anyone can install the log splitter, regardless of the person's age or health. The top of the attacher surface is received under the top lip of the mounting frame, and the attacher wedges extend through the holes in the bottom flange of the mounting frame. The levers are actuated to lock the wedges in place through the holes in the bottom flange of the mounting frame, and hence lock the log splitter in place.

The head is in cooperating alignment with the blade. In this regard, the head and blade cooperate to grasp and pick up logs off the ground. The entire log splitter can be rotated in the same manner as conventional attachments. The log splitter can then move about with a log grasped between the head and blade. The log splitter attachment can be positioned with a log in place over a receptacle before splitting the log.

Further, the log splitter attachment has a stroke length independent of the lift cylinder stroke length of a host vehicle. Hence, the log splitter of the present invention is not limited to splitting logs shorter that the lift cylinder stroke length.

Other advantages, benefits, and features of the invention will become apparent to those the skilled in the art upon reading the detailed description of the invention and studying the drawings.

DETAILED DESCRIPTION OF THE PREFERRED EMBODIMENTS

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
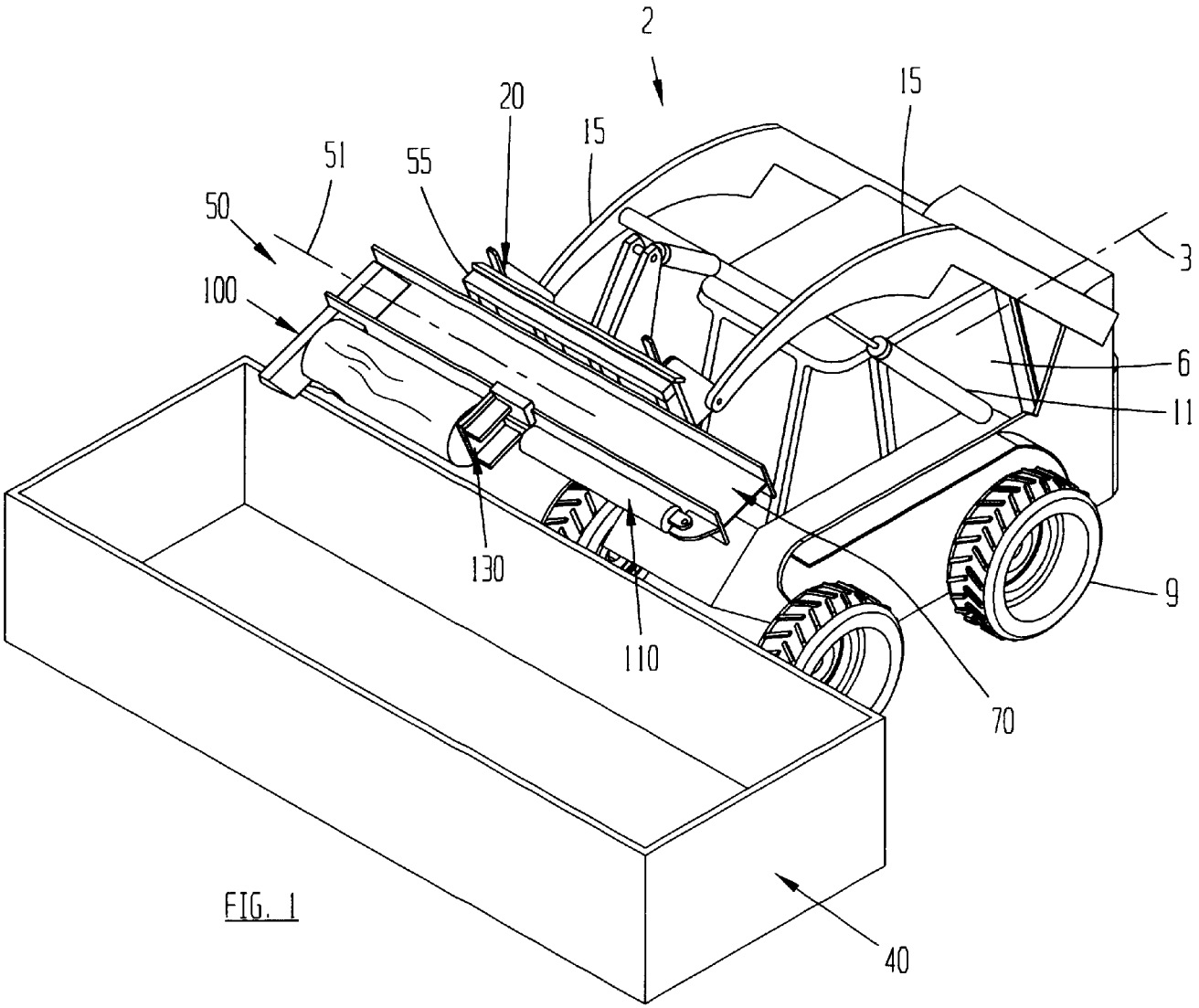
FIG. 1 is a perspective view of the present invention showing the log splitter attached to a skid loader and a log being grasped over a receptacle.
Figure 2:
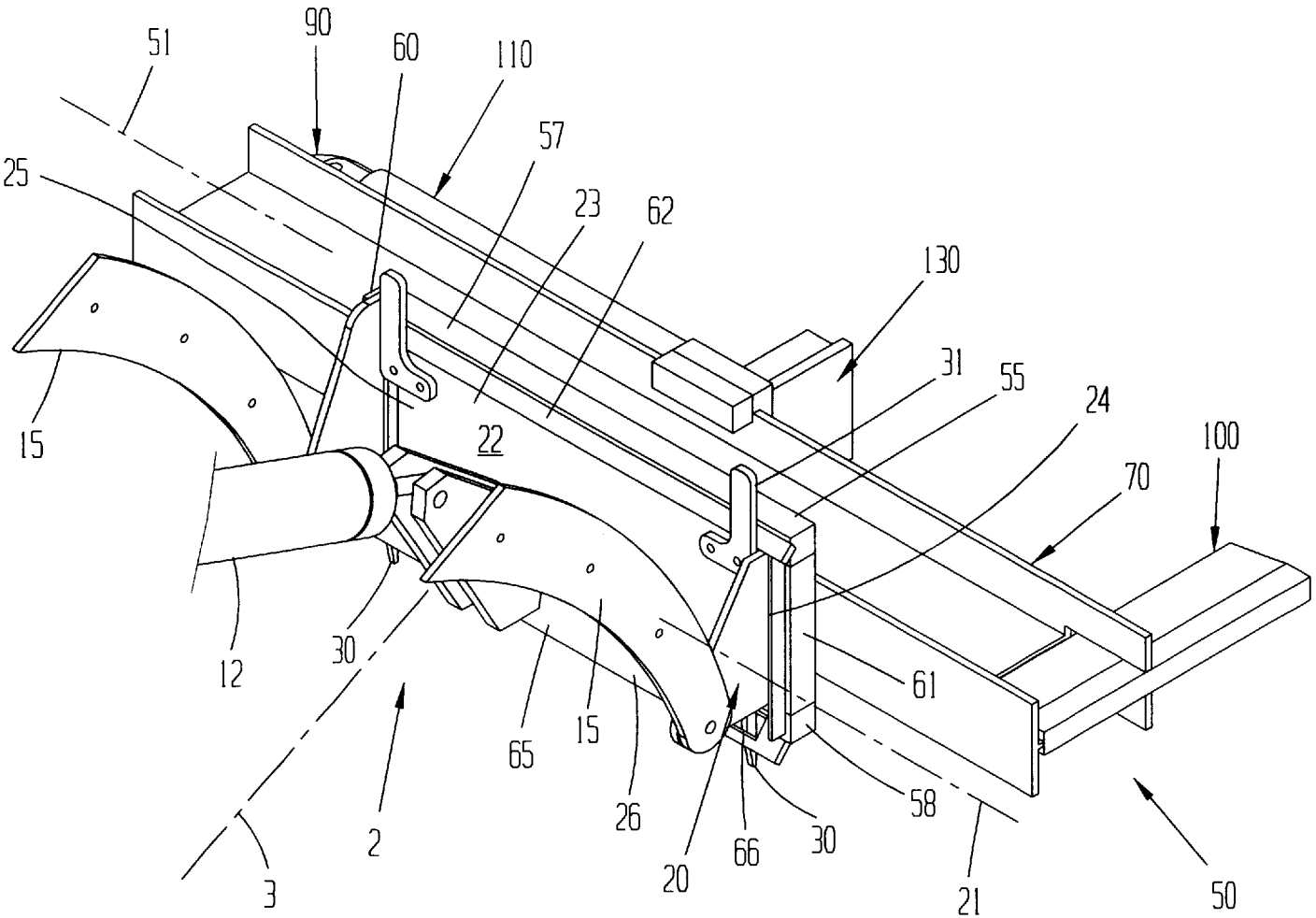
FIG. 2 is a perspective view of the lift arms, tilt cylinder, and attacher of a conventional skid loader with the attacher attached to the present invention.

One type of conventional host vehicle is a skid loader 2, which is shown in FIG. 1. A skid loader 2 has a longitudinal axis 3. The skid loader 2 also has a cab 6 for the user. An engine (not shown) provides power to tires 9 in order to move the skid loader 2. The skid loader 2 has a hydraulic pump (not shown) that provides hydraulic power to two lift cylinders 11 and a tilt cylinder 12. As shown in FIG. 2, the lift cylinders 11 are each connected to a respective lift arm 15. An example of a satisfactory skid loader is the 773 Bobcat Loader manufactured by Melroe Ingersoll-Rand of Gwinner, N.Dak.

The skid loader 2 further has an attacher 20 with a longitudinal axis 21. The attacher 21 is best shown in FIG. 2. The attacher longitudinal axis 21 is perpendicular to the skid loader longitudinal axis 3. The attacher 20 has a generally rectangular-shaped surface 22. The attacher surface 22 has a top 23, a right end 24, a left end 25, and a bottom 26. Two wedges 30 are on the bottom 26 of the attacher surface 22. Two levers 31 are provided for actuating the wedges 30, respectively, in a well-known manner, to move the wedges in upward and downward directions. One or more hoses (not shown) are connected to the hydraulic pump for supplying hydraulic power to an attachment that is mounted to the attacher.

The attacher 20 is at the front of, and connected to, the front ends of each respective lift arm 15. The tilt cylinder 12 is also connected to the attacher 20. The lift arms 15 lift the attacher 20 to a desired height and the tilt cylinder 12 orients the attacher 20 about the attacher longitudinal axis 21. Hence, it is seen that the attacher 20 can be lifted and oriented to any of a multitude of positions relative to the remainder of the skid loader 2. For purposes of illustration, references to spatial orientation contained herein refer to the attacher 20 and the present invention as the invention rests on the ground viewed from within the skid loader 2. However, it is readily understood that, as the orientation of the attacher 20 changes, the orientation of the present invention mounted to the attacher 20 also changes.

In accordance with the present invention, a log splitter 50 is provided. The log splitter 50 is shown perspectively in FIG. 3. The log splitter 50 preferably has an overall length of approximately 7 feet, 6 inches, and an overall depth of approximately 2 feet, 8 inches. The log splitter 50 has a longitudinal axis 51.

The log splitter 50 of the present invention has a mounting frame 55, as shown in FIGS. 2–9. The mounting frame 55 preferably has a height of approximately 1 foot, 7 inches, and a length of approximately 3 feet, 9 inches. The mounting frame 55 comprises vertical beams 56 that lie in a common plane and that span between a top rail 57 and a bottom rail 58. Preferably four beams 56 span between the top and bottom rails 57 and 58. The beams 56 are covered with a plate 67. Plate 67 lies in and defines the common plane in which the vertical beams 56 lie in.

Figure 9:
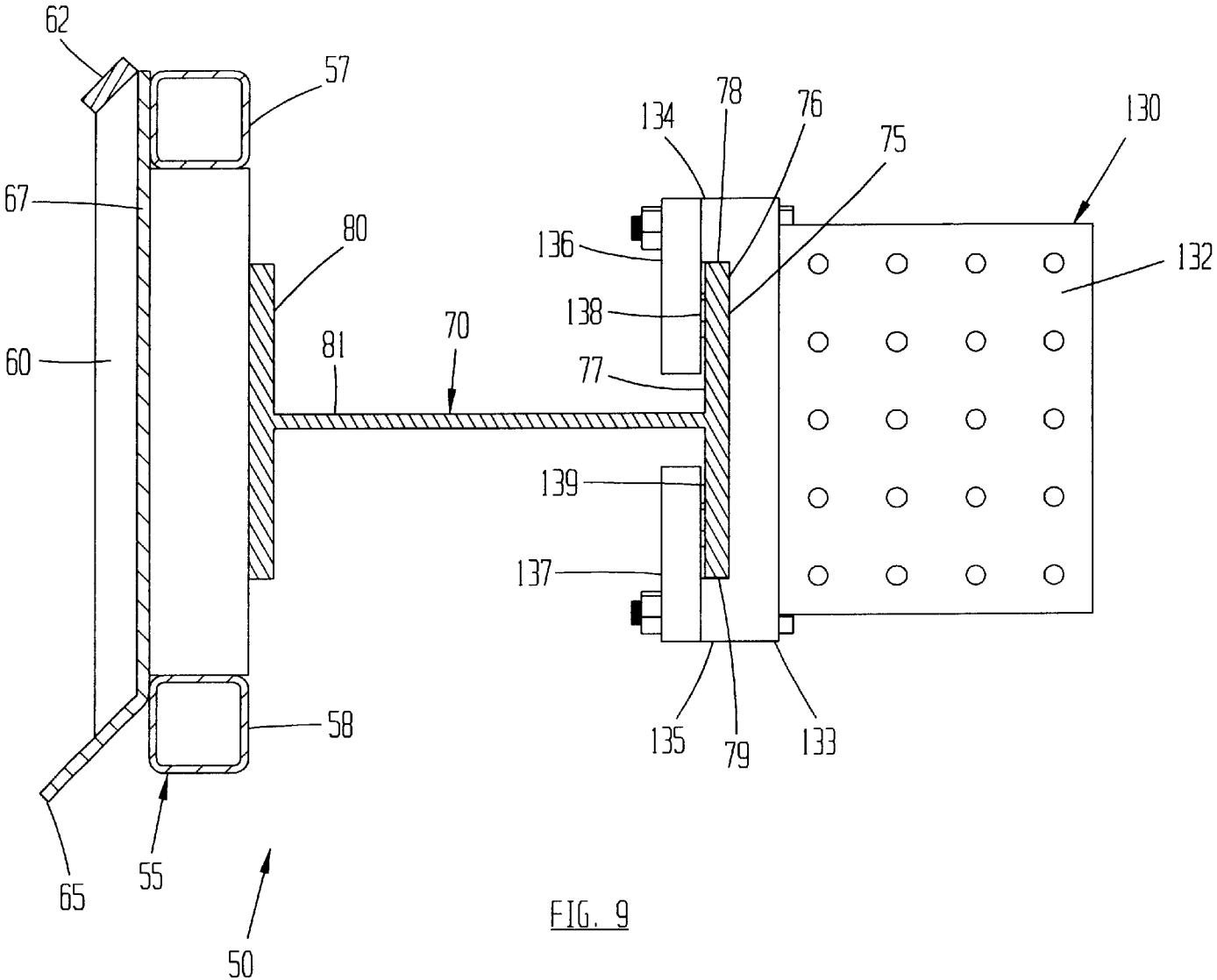
FIG. 9 is a cross-sectional view taken along line 9—9 in FIG. 4.

A left lip 60 extends rearward from the leftmost rail at the left side of the mounting frame 55. An opposed right lip 61 extends rearward from the rightmost rail at the right side of the mounting frame 55. A top lip 62 having a longitudinal dimension generally parallel to the longitudinal axis 51 extends rearwardly from the top rail 57. The top lip 62 is rearwardly angled approximately 40 to 50 degrees relative to the common plane defined by plate 67. However, an outwardly extending lip (not shown) perpendicular to the common plane and a corresponding downwardly extending flange (not shown) parallel to the common plane can be used in place of the angled top lip 62 without departing from the broad aspects of the invention. The plate 67 is bent at the bottom rail 58, forming a bottom flange 65 having a longitudinal dimension preferably parallel to the top lip 62. The bottom flange 65 preferably extends rearwardly at an angle of about 40 to 50 degrees relative to common plane defined by plate 67. It is preferred that the top lip 62 and bottom flange 65 lie in parallel planes and are angled 46 degrees relative to the common plane defined by plate 67, as is shown in FIG. 9. Also shown in FIG. 9, bottom flange 65 rearwardly extends approximately twice as far as top lip 62. The bottom flange 65 has two holes 66 therethrough. As an alternative, two flanges (not shown) each having a respective hole could extend from the bottom rail 58 rather than a single flange 65.

The log splitter 55 also has an H-beam 70, which is best shown in FIGS. 1–3, and 9. The H-beam 70 is preferably made from a strong metal, such as steel. Strength and durability are prevailing factors in material quality. The material weight is of a lesser concern than strength and durability. The H-beam 70 has a longitudinal axis 71. The H-beam preferably has a depth of approximately 1 foot. The H-beam 70 has desirable structural qualities, such as high strength and stiffness. However, other beam structures could be used without departing from the broad aspects of the invention. The H-beam 70 has a first end 72 and an opposed second end 73. The H-beam 70 has a front flange 75 with an outer surface 76, an inner surface 77, a first side surface 78 and a second side surface 79. The H-beam 70 also has a rear flange 80, and a web 81 that separates the front and rear flanges 75 and 80.

The H-beam longitudinal axis 71 is parallel to the log splitter longitudinal axis 51. The H-beam is connected to the mounting frame 55. In particular, the rear flange 80 of the H-beam 70 is connected to the vertical beams 56 of the mounting frame 55. The H-beam 70 is preferably welded to the mounting frame 55.

A piston assembly support plate 90 is welded or otherwise connected to the front flange 75 of the H-beam 70, at the first end 72 of the H-beam 70. The piston assembly support plate 90 is preferably located equidistantly between the first and second side surfaces 78 and 79 of the front flange 75 of the H-beam 70. The piston assembly support plate 90 has a hole 91 therethrough. The piston assembly support plate 90 is best shown in FIGS. 3–5, and 7.

Figure 3:
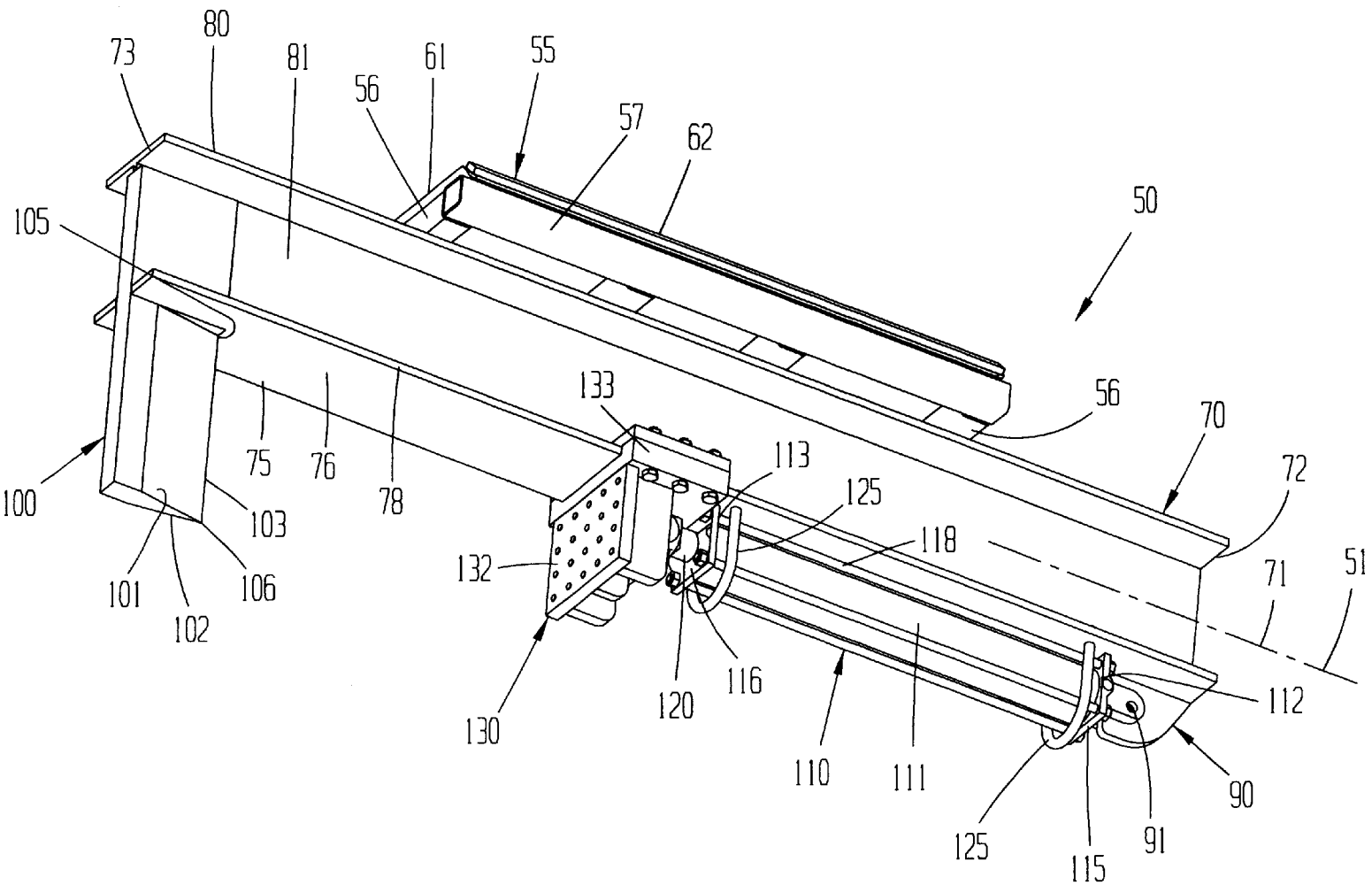
FIG. 3 is a perspective view of the log splitter of the present invention.
Figure 4:
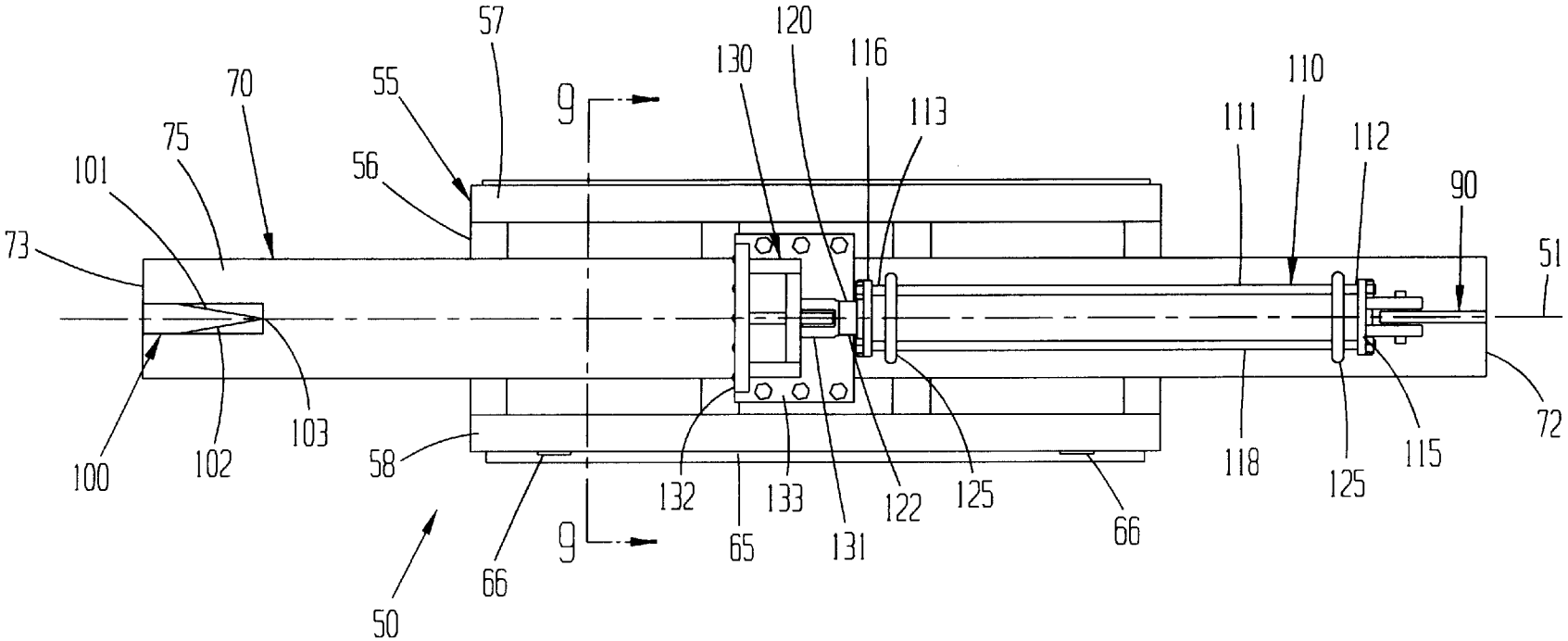
FIG. 4 is a front view of the log splitter shown in FIG. 3.
Figure 5:
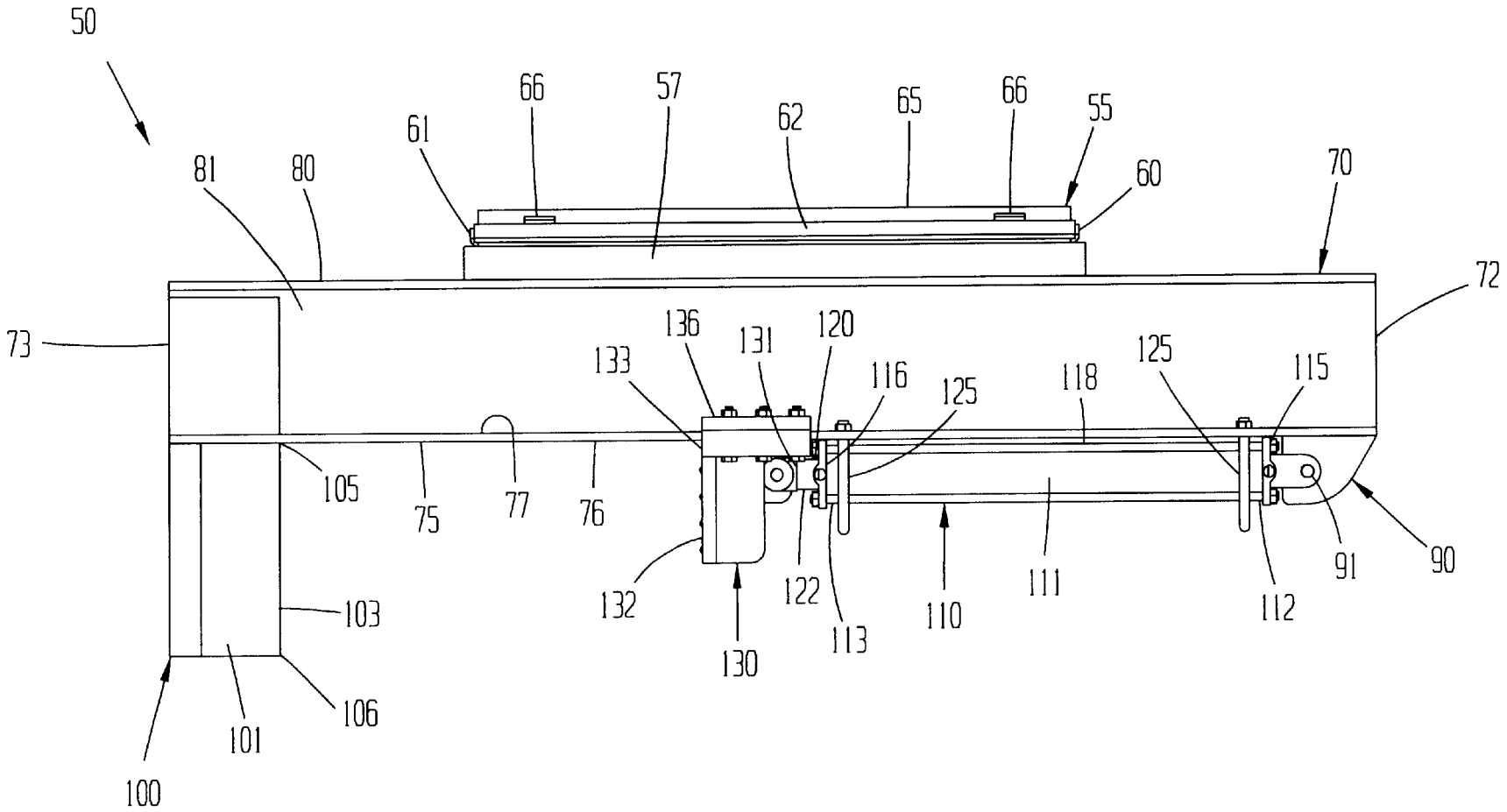
FIG. 5 is a top view of the log splitter shown in FIG. 3.
Figure 6:
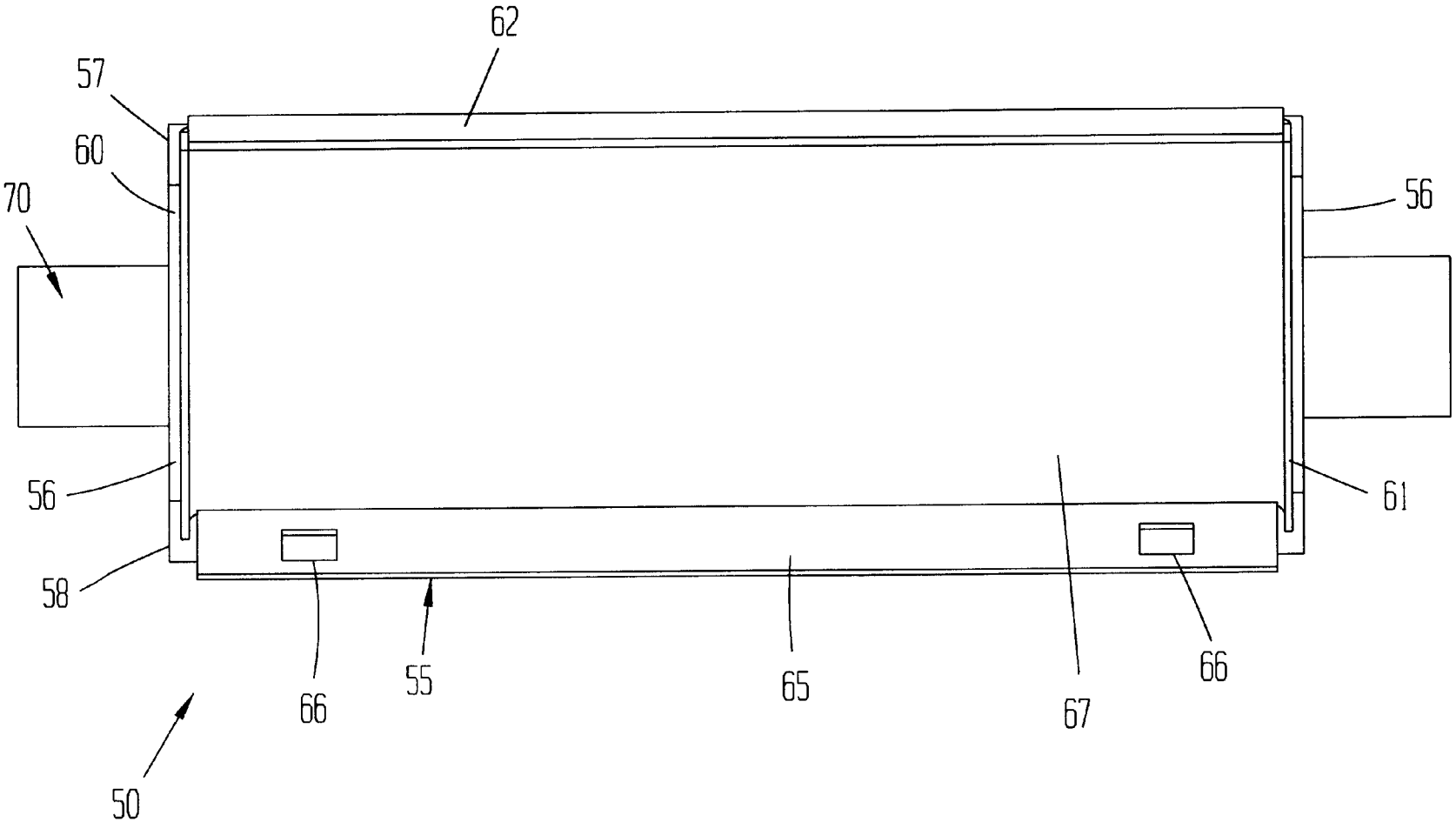
FIG. 6 is a rear view of the log splitter shown in FIG. 3.

The log splitter 50 further comprises a blade 100, which is shown in FIGS. 3–5. The blade 100 is preferably stationarily and rigidly secured to the second end 73 of the H-beam 70. The blade 100 has a first side 101 and a second side 102. The sides 101 and 102 have portions that converge to form a cutting edge 103. The cutting edge 103 is generally perpendicular to the H-beam longitudinal axis 71, and points toward the first end 72 of the H-beam 70. The blade 100 has a joint end 105 at the H-beam 70 and a free end 106 opposite the joint end 105. Cutting edge 103 is preferably approximately 1 foot, 4 inches long.

The log splitter also has a piston assembly 110, which is best shown in FIGS. 3–5. The piston assembly 110 has a casing 111 with a first end 112 and a second end 113. A first cap 115 is attached to the first end 112 of the casing 111, and a second cap 116 is attached to the second end 113 of the casing 111. A collar (not shown) can be connected to the second cap 116 at the second end 113 of the casing 111. Four support rods 118 ensure that the first and second caps 115 and 116 remain on the ends 112 and 113 of the casing 111.

A piston rod 120 having a first end (not shown) and a second end 122 is received within the casing 111. The second end 122 of the piston rod 120 extends out from the second end 113 of the casing 111 through the second cap 116. The piston rod 120 can selectably extend from and retract into the casing 111.

Figure 7:
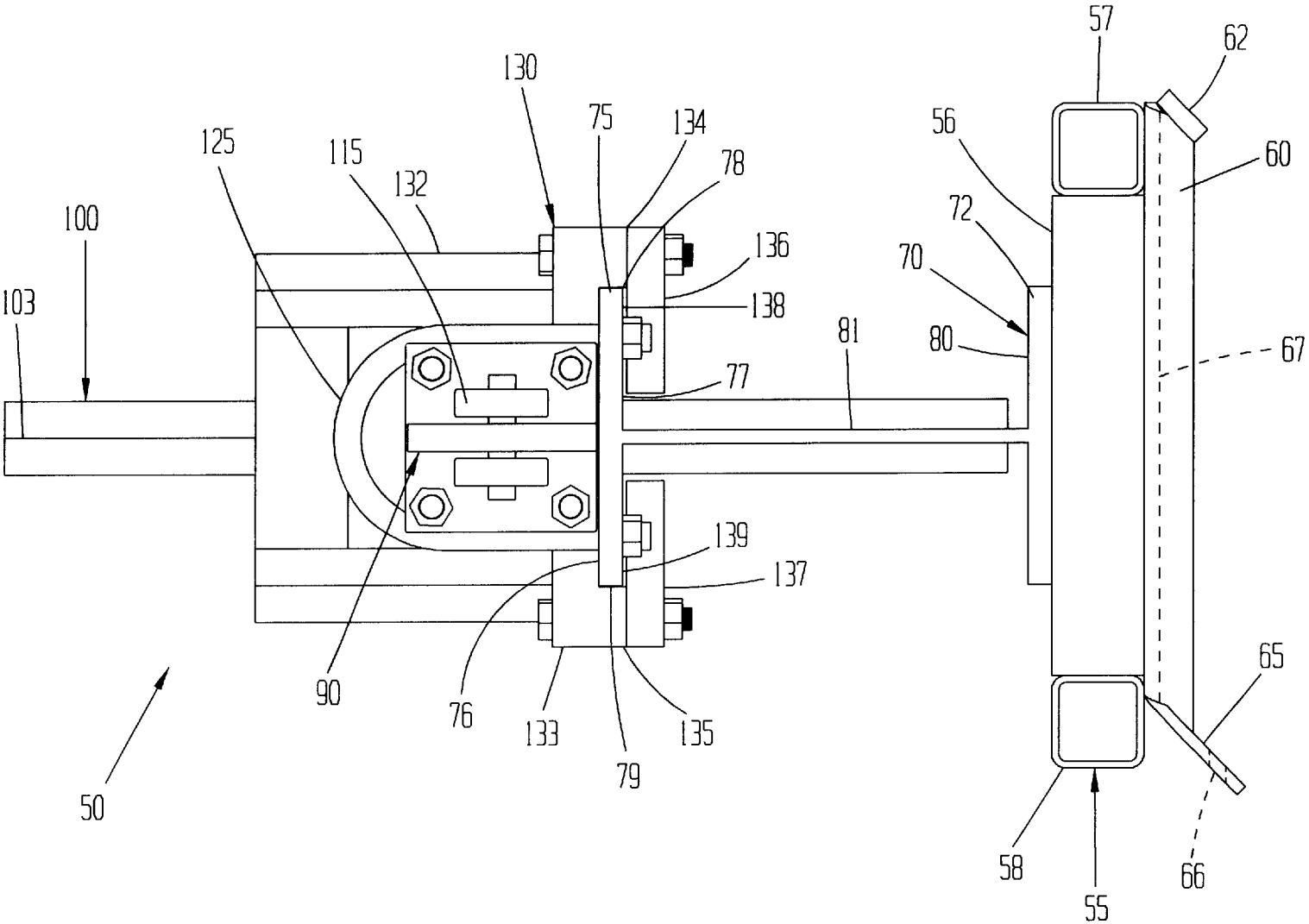
FIG. 7 is a first end view of the log splitter shown in FIG. 3.
Figure 8:
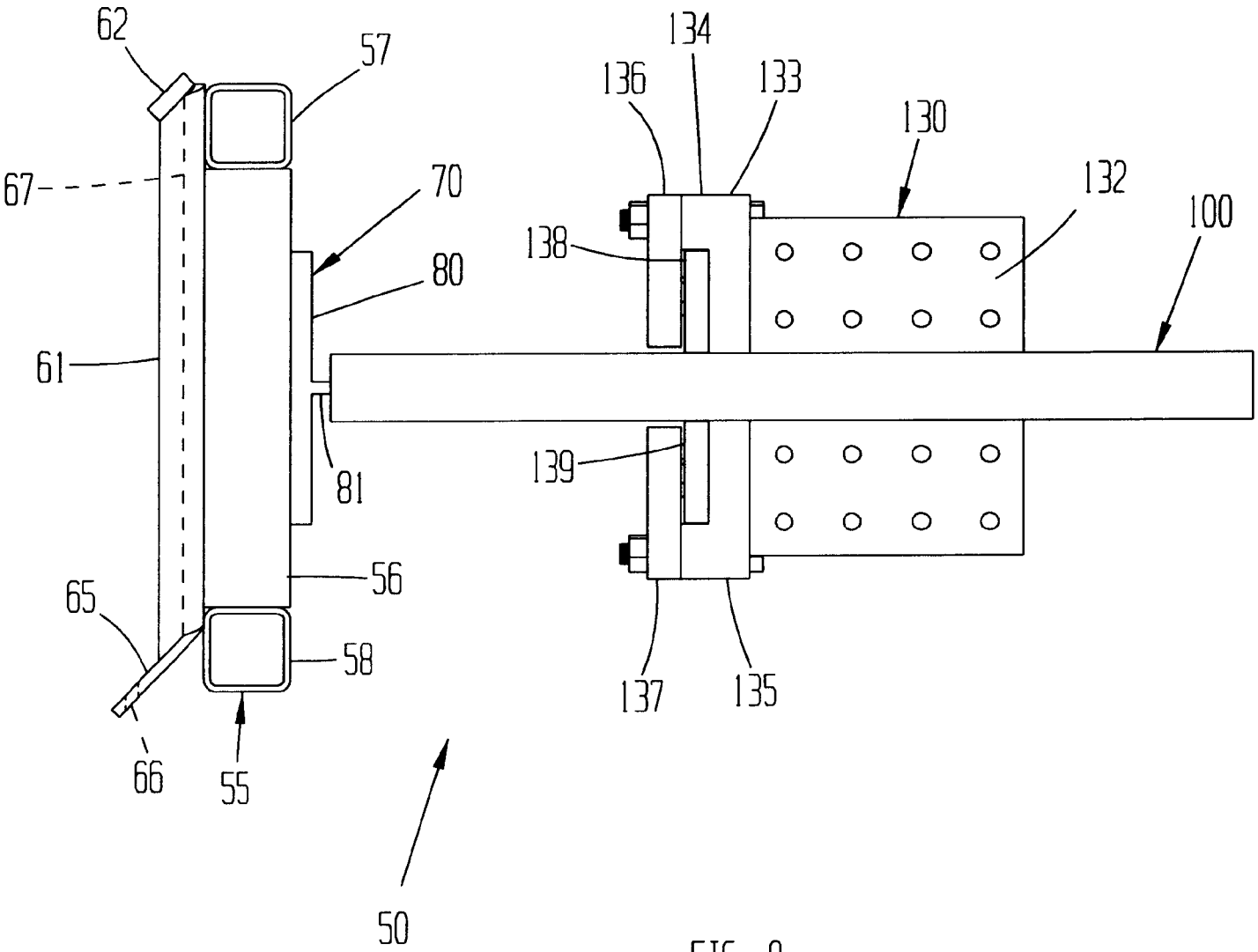
FIG. 8 is a second end view of the log splitter shown in FIG. 3.

The first cap 115 has two cap plates, as best shown in FIG. 7. The cap plates lie in planes parallel to the log splitter longitudinal axis 51. The cap plates sandwich the piston assembly support plate 90. A bolt or the like can be aligned with holes through the cap plates and the hole 91 through the piston assembly support plate 90. Hence, it is readily seen that the piston assembly support plate 90 provides support to the piston assembly 110 in a direction parallel to the log splitter longitudinal axis 51, as shown in FIGS. 3–5. A pair of U-shaped bolts 125 secures the piston assembly 110 to the front flange 75 of the H-beam 70 to prevent movement of the piston assembly 110 in directions perpendicular to the log splitter longitudinal axis 51. The U-shaped bolts 125 are connected to the front flange 75 of the H-beam 70. Each U-shaped bolt 125 is preferably approximately 8.5 inches long.

A further component of the log splitter 50 is a head 130, as best seen in FIGS. 3–5 and 9. The head 130 has a neck 131 for receiving the second end 122 of the piston rod 120. A pusher plate 132 is opposite the neck 131. The pusher plate 132 has several knobs on its face. The head 130 also has a track plate 133 with a first lip 134 and a second lip 135. The lips 134 and 135 are spaced apart a predetermined distance slightly greater than the width of the front flange 75 of the H-beam 70. The lips 134 and 135 are preferably integral with the track plate 133. A first cuff 136 is connected to the first lip 134, and a second cuff 137 is connected to the second lip 135. The lips 134 and 135 and respective cuffs 136 and 137 are preferably bolted together to form a first channel 138 and a second channel 139. The front flange 75 of the H-beam 70 is received within the channels 138 and 139.

It is apparent that the location of the blade 100 and the head 130 could be switched without departing from the broad aspects of the invention. In this regard, the blade 100 could be connected to the piston assembly 110 and the head 130 could be located at the second end 73 of the H-beam 70.

Turning now to the operation of the present invention, it is readily understood that the log splitter 50 interchangeably mounts to a skid loader 2. To accomplish this, the attacher 20 of the skid loader 2 engages the mounting frame 55 of the log splitter 50, as shown in FIG. 2. More particularly, the user orients the skid loader 20 with the attacher 22 in the lowered position adjacent the mounting frame 55 of the log splitter 50, such that the attacher longitudinal axis 21 is parallel to the log splitter longitudinal axis 51. The top 23 of the surface 22 of the attacher 20 is rotated slightly forward relative to the remainder of the attacher 20. The top 23 is then positioned such that it is received under the top lip 62 of the mounting frame 55. The left and right lips 60 and 61 engage the respective left end 24 and right end 25 of the surface 22 of the attacher 20. The bottom 26 of the surface 22 of the attacher 20 engages the bottom plate 65 of the mounting frame by extending the wedges 30 through the holes 66 through the bottom flange 65. The levers 31 lock the wedges 30 in the holes 66 in the well-known manner, and hence lock the log splitter 50 to the attacher 20 of the skid loader 2.

The log splitter 55 is removed in the opposite manner. The skid loader 2 lowers attacher 20 until the log splitter 50 rests on the ground. The user then unlocks the levers 31 and retracts the wedges 30. The attacher 20 is rotated so that the top 23 is slightly forward of the bottom 26. The skid loader then lowers the attacher 20 so that the top 23 of the surface 22 of the attacher 20 is below the top lip 62 of the mounting frame 55. The skid loader 2 is then driven in reverse away from the log splitter 50.

With the log splitter 50 mounted to the attacher 20, it is readily apparent that the log splitter 50 can be reoriented to any desired position wherein the log splitter longitudinal axis 51 remains perpendicular to the skid loader longitudinal axis 3. The user simply raises and lowers the lift arms 15 to raise and lower the log splitter 50. Further, the tilt cylinder 12 controls the orientation of the log splitter 50 about the log splitter longitudinal axis 51.

The hoses (not shown) supply hydraulic power to the piston assembly 110 in order to extend and retract the piston rod 120. It is contemplated, however, that the piston assembly 110 could have a power source that is independent of the host vehicle, such as an electric motor (not shown) or internal combustion engine (not shown). The piston rod 120 drives the head 130 along its path. The head 130 moves adjacent the front flange 75 of the H-beam 70. The channels 138 and 139 engage the front flange 75. The log splitter preferably can accommodate logs having a length up to approximately 2 feet, 7.5 inches.

In accordance with the present invention, a skid loader 2 with a log splitter 50 attached thereto, can pick a log up off from the ground, move while holding the log, and split the log over a storage receptacle 40. The head 130 and blade 100 are in cooperating alignment, such that the head 130 and blade 100 can be positioned at opposite ends of a log resting on the ground. The piston assembly 110 can then force the head 130 to move adjacent the H-beam towards the blade 100, thereby grasping the log. The skid loader 2 can then move about with a log grasped, just as when the skid loader 2 has any conventional attachment attached.

Thus it is apparent that there has been provided, in accordance with the invention, a log splitter attachable to a skid loader that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A log splitter for being interchangeably mounted to a host vehicle comprising:

a. a mounting frame comprising:

i. a rearwardly extending top lip for being selectively engaged and disengaged by a host vehicle: and ii. a rearwardly extending bottom flange with at least one hole formed therethrough for being selectively engaged and disengaged by the host vehicle, b. a beam connected to and forwardly of said mounting frame and having a longitudinal axis, a first beam end and a second beam end;

c. a head and a blade in cooperating alignment; and d. a piston assembly connected to said first beam end and having a piston rod that is connected to a selected one of said head and said blade, and the other of said selected one of said head and said blade being stationarily connected to said beam, said selected one of said head and said blade sliding along a path adjacent to said beam and parallel to said beam longitudinal axis in response to actuating said piston assembly to thereby split a log between said head and said blade.

2. The log splitter of claim 1 further comprising at least one U-shaped bolt connecting said piston assembly to said beam.

3. The log splitter of claim 1:

a. wherein said mounting, frame further comprises mounting frame beams that lie in a common plane, and b. wherein said rearwardly extending top lip and said rearwardly extending bottom flange are outwardly angled relative to said common plane of said mounting frame beams.

4. The log splitter of claim 3 wherein said rearwardly extending top lip and said rearwardly extending bottom flange are angled approximately 40 to 50 degrees relative to said common plane of said mounting frame beams.

5. The log splitter of claim 4 wherein said bottom flange has two holes therethrough.

6. The log splitter of claim 3 wherein:

a. said beam is H-shaped with a first H-beam flange attached to said mounting frame beams and a second H-beam flange; and b. said selected one of said head and said blade is slidable along said second H-beam flange.

7. The log splitter of claim 3 wherein said mounting frame top lip and said mounting frame bottom flange are generally parallel to each other and to said beam longitudinal axis.

8. The log splitter of claim 1 wherein said piston assembly is powered with hydraulic power supplied by the host vehicle.

9. The log splitter of claim 1 wherein said mounting frame further comprises side lips that engage the host vehicle.

10. In combination:

a. a host vehicle with a host vehicle longitudinal axis and comprising an attacher with an attacher top and an attacher bottom and having an attacher longitudinal axis, wherein:

i. said host vehicle is capable of rotating said attacher about said attacher longitudinal axis; and ii. said attacher longitudinal axis remains perpendicular to said host vehicle longitudinal axis when said attacher rotates about said attacher longitudinal axis; and b. a log splitter with a log splitter longitudinal axis perpendicular to said host vehicle longitudinal axis and parallel to said attacher longitudinal axis and comprising:

i. a mounting frame comprising:

A. a top lip at a top of said mounting frame for receiving said attacher top; and B. a bottom flange at a bottom of said mounting frame for receiving said attacher bottom;

ii. a piston assembly supported by said mounting frame; and iii. a head and a blade in cooperating alignment, wherein a selected one of said head and said blade is moveable under the influence of said piston assembly and the other is fixed relative to the mounting frame.

11. The combination of claim 10 wherein said selected one of said head and said blade is moveable parallel to said log splitter longitudinal axis.

12. The combination of claim 10 wherein said log splitter further comprises a beam connected to said mounting frame, wherein said piston assembly and the other of said selected one of said head and said blade is rigidly connected to said beam.

13. The combination of claim 12 wherein said log splitter further comprises at least one U-shaped bolt connecting said piston assembly to said beam.

14. The combination of claim 10 wherein said host vehicle hydraulic provides power to said piston assembly to move said selected one of said head and said blade.

15. The combination of claim 10 wherein said host vehicle is a skid loader.

16. The combination of claim 10 wherein said host vehicle further comprises:

a. lift arms to raise and lower said attacher and thereby raise and lower said log splitter; and b. a tilt cylinder to change the orientation of said attacher about said attacher longitudinal axis to thereby chance the orientation of said log splitter about said log splitter longitudinal axis.

17. The combination of claim 10 wherein:

a. said mounting frame comprises multiple mounting frame beams that generally lie in a common plane:

b. said top lip is outwardly angled approximately 40 to 50 degrees relative to said common plane; and c. said bottom flange is outwardly angled approximately 40 to 50 degrees relative to said common plane.

18. A method of splitting logs comprising the steps of:

a. providing a host vehicle having a host vehicle longitudinal axis, and with an attacher comprising an attacher top and an attacher bottom, and with lift arms and a tilt cylinder connected to the attacher;

b. providing a log splitter with a log splitter longitudinal axis and with:

i. a mounting frame having a top lip, and a bottom flange with holes formed therethrough;

ii. a piston assembly supported by said mounting frame; and iii. a blade and a head in cooperating alignment and at a predetermined distance apart;

c. mounting the log splitter to the host vehicle comprising the steps of:

i. receiving the attacher top under the mounting frame top lip; and ii. engaging the attacher bottom to the mounting frame bottom flange;

d. placing a log between the head and blade; and e. actuating the piston assembly to decrease the predetermined distance and split the log.

19. The method of claim 18 wherein:

a. the step of placing a log comprises the step of placing the log on the ground; and b. the step of actuating the piston assembly comprises the step of gripping the log between the head and blade prior to splitting the log.

20. The method of claim 19 comprising the further step of moving the host vehicle subsequent to gripping the log and prior to splitting the log.

21. The method of claim 18 wherein the step of mounting the log splitter to the host vehicle comprises the further step of manipulating the attacher to lock the attacher into the holes through the bottom flange.

* * * * *